United States Patent [19]

Havard et al.

[11] Patent Number: 4,901,982

[45] Date of Patent: Feb. 20, 1990

[54] METHOD INTENDED TO FACILITATE DISENGAGEMENT OF MECHANISMS APPLYING HIGH STRESS TO ONE ANOTHER

[75] Inventors: Jean Havard, Carquefou; Christian Ravet, Nantes, both of France

[73] Assignee: Brissonneau et Lotz Marine, Puteaux, France

[21] Appl. No.: 266,295

[22] Filed: Oct. 31, 1988

Related U.S. Application Data

[60] Division of Ser. No. 157,074, Feb. 3, 1988, abandoned, which is a continuation of Ser. No. 788,048, Oct. 16, 1985, abandoned.

[30] Foreign Application Priority Data

Oct. 16, 1984 [FR] France ..... 8415965

[51] Int. Cl.[4] ..... B66F 3/02

[52] U.S. Cl. ..... 254/95; 254/105; 254/97

[58] Field of Search ..... 254/105–107, 254/892, 95, 97, 112; 405/198

[56] References Cited

U.S. PATENT DOCUMENTS

| | | | |
|---|---|---|---|
| 3,986,368 | 10/1976 | Levingston | 254/105 |
| 4,203,576 | 5/1980 | Sutton | 254/95 |
| 4,269,543 | 5/1981 | Goldman et al. | 254/95 |
| 4,453,858 | 6/1984 | Guiader | 254/95 |
| 4,495,824 | 1/1985 | Dantan | 73/862.64 |

FOREIGN PATENT DOCUMENTS

| | | | |
|---|---|---|---|
| 2487775 | 7/1985 | France . | |
| 2064624 | 11/1979 | United Kingdom | 405/198 |

*Primary Examiner*—Frederick R. Schmidt
*Assistant Examiner*—Judy J. Hartman
*Attorney, Agent, or Firm*—Rines and Rines, Shapiro and Shapiro

[57] ABSTRACT

A system and method are provided to facilitate disengagement of two mechanisms engaged with one another with a high stress therebetween, such as in rack locking arrangements used on offshore platforms. The first mechanism (e.g., a rack) is mobile in relation to the second mechanism (e.g., a pair of locking jaws) which serves as a locking mechanism for the first mechanism. The level of stress between the first and second mechanisms is measured, and the measurement is converted into an electrical control signal. This signal is used to control motor-driven force applying elements (e.g., pinions) in engagement with the first mechanism. The force applying elements are controlled in such a manner as to apply force to the first mechanism sufficient to offset the aforementioned stress between the first and second mechanisms, thereby permitting friction-free disengagement of the mechanisms.

4 Claims, 1 Drawing Sheet

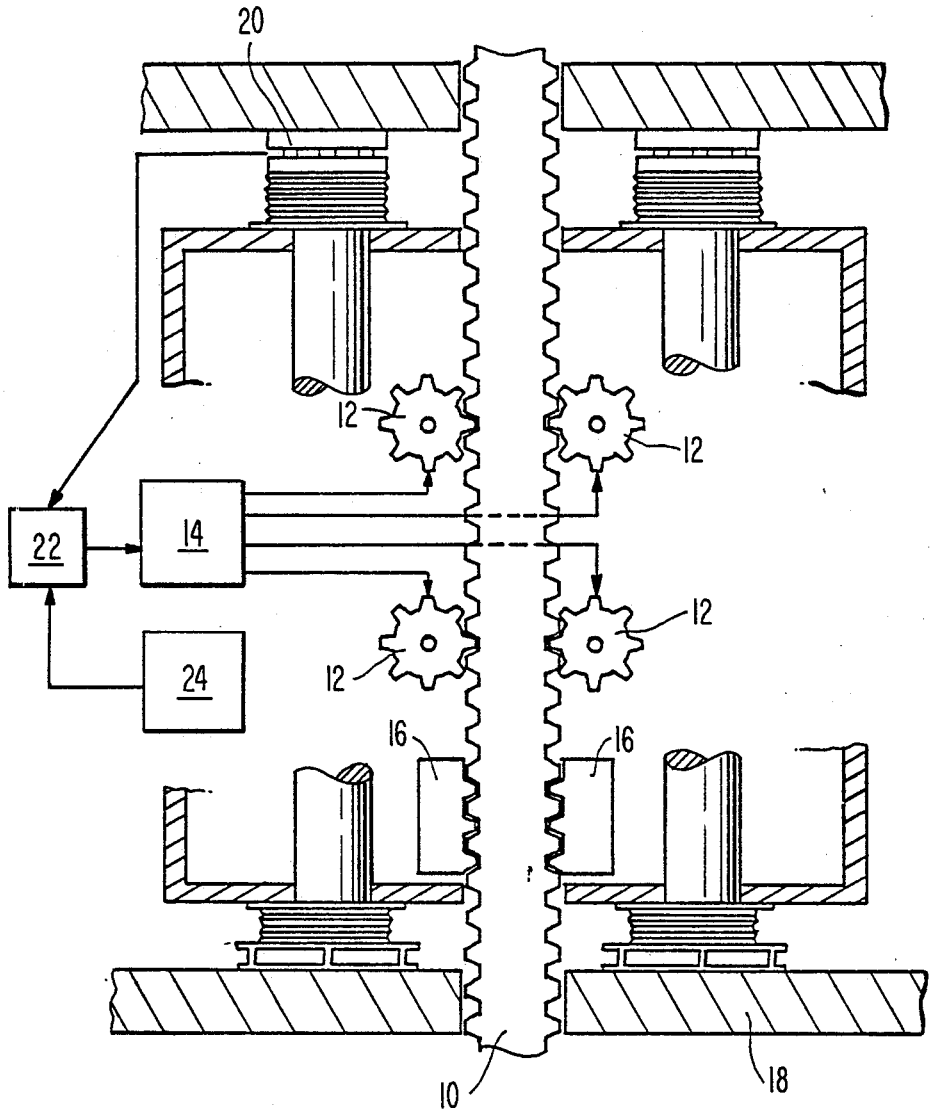
20
12
12
22
14
12
24
12
16
16
10
18

METHOD INTENDED TO FACILITATE DISENGAGEMENT OF MECHANISMS APPLYING HIGH STRESS TO ONE ANOTHER

This is a division of application Ser. No. 157,074 filed Feb. 3, 1988, which is a continuation of application Ser. No. 788,048 filed Oct. 16, 1985, both of which are now abandoned.

The present invention pertains to a method and to a system which are intended to facilitate disengagement of mechanisms which apply high stress to one another. In more specific terms, the invention pertains to a method and to a system which shall allow disengagement of one or more locking mechanisms controlling a rack so as to prevent lengthwise shifting of the respective rack, especially in lifting mechanisms for offshore platforms.

The state of the art includes lifting mechanisms wherein a rack containing double sets of teeth fits between at least one set of pinions which are to be placed in rotation in a synchronized manner by reduction gear assemblies. In some instances, these mechanisms include sets of jaws which are mounted upon a surface and which have teeth complementary to the teeth of the aforementioned rack in order to allow engagement with the rack for obtaining lengthwise locking. Hence, the previously cited jaws perform the functions of a locking assembly which shall prevent the rack and the platform from moving in relation to one another.

Nevertheless, when excessive stress is applied between the rack and the respective jaws, it becomes impossible and/or hazardous to open the jaws in order to release the rack, especially in the presence of storms or rough seas.

As a result of French Patent Number 2,487,775, which was granted to the Applicant, the state of the art also includes a safety mechanism for offshort platforms, wherein pinions mounted upon a supporting frame are connected to the platform. In turn, a disengaging brake which is capable of engaging with the rack is linked to the axles of said pinions. It is preferable for the supporting frame to be connected to the platform by means of a cam-mounted joint which allows horizontal shifting of said frame in order to allow adjustments for lateral movement.

The present invention pertains to a method and to a system which facilitate releasing of one or more locking mechanisms without allowing shifting of the aforementioned rack in relation to the platform. Such shifting is undesirable in that it can cause damage to components which are in contact, notably the teeth on toothed components, as well as adversely effect the stability of the platform.

In summary, the present invention pertains to a method of permitting disengagement of mechanisms which may apply high stress to one another, with the first of said mechanisms being mobile in relation to the second and the second mechanism being intended to ensure locking. This particular method is characterized by the fact that it includes the following stages:

(a) Measurement of the level of stress applied between the first and second mechanisms;

(b) Conversion of the aforementioned stress level into an electrical level for a control current;

(c) Applying said current to one or more electric motors which shall act upon the first mechanism, with the aforementioned electrical level being sufficient for the electric motor or motors to transmit a level of power to the first mechanism which shall essentially offset stress existing between both mechanisms in order to allow disengagement of said mechanisms in a manner permitting elimination of any stress between them.

The present invention likewise pertains to means of applying the previously cited method, including:

(a) Means of measuring the level for stress being applied between the first and second mechanisms;

(b) Means for converting the aforementioned level of stress into an electrical level for a control current;

(c) Components powered by an electric motor and shall be positioned so as to transmit power to the first mechanism according to a direction and an intensity which are essentially identical to those of the aforementioned stress.

A full understanding of the invention may be had from the subsequent description, which is provided in a non-restrictive form, with reference to the accompanying drawing. The single drawing FIGURE is a schematic cut away view of a lifting mechanism for an offshore platform of the conventional type in which the present invention has been incorporated.

Within the aforementioned drawing, items which are not essential to explanation of the present invention have been presented in a partial form, or omitted.

Reference number (10) identifies a double rack column which can be moved vertically by means of one or more pairs of pinions (12) containing teeth arranged in a complementary manner. These pinions are powered by motorized reduction gear assemblies represented by the reference number (14).

Two locking mechanisms (16), which are integral with a frame (18), are positioned so as to keep the rack (10) in place when it occupies the desired positions. The mechanisms which control crosswise movement of these locking mechanisms do not appear in the diagram.

When it is necessary, for any reason, to release locking mechanisms (16), which are shown in a locking position within the drawing, vertical stress between frame (18) and locking mechanisms (16) should be minimized. Minimizing such vertical stress will prevent deterioration of components of the rack (10) and of mechanisms (16) and will also prevent sudden shifting of the rack (10) in relation to the frame (18). Measurement of the stress existing between the aforementioned components can be obtained by conventional stress measurement devices (20). The respective measurement, represented by an electrical parameter, for example, is transmitted to a control unit (22) designed to convert said measurement into an electrical control parameter, such as current, voltage, or frequency. The control parameter is used to control the motor of the reduction gears assemblies (14). In this way, pinions (12) may be rotated to apply sufficient torque for substantially offsetting vertical stress between the rack and the previously cited locking mechanisms (16).

Accordingly, the load or stress applied between the rack and the locking mechanisms (16) can be essentially reduced to zero, and it becomes possible to release said locking mechanisms in a reliable and convenient manner.

It is appropriate to observe that persons skilled in the art will readily be capable of ensuring that the electric motor is powered in a suitable manner for the torque to correspond to a predetermined level when the shaft is locked.

In situations where stress between the rack (10) and the locking mechanisms (16) is not strictly vertical, different torques may be applied to the pinions (12), depending upon whether they are situated to the left or to the right of the rack shown in the drawing. This condition can be obtained by means of two stress measurements provided by the devices (20) on the left and right sides of the diagram.

Moreover, devices containing photoelectric cells (24) may be included for controlling the power unit (22). According to the positions of sets of teeth on the rack (10) in relation to the locking mechanisms (16), these devices will ensure even distribution of vertical play between said teeth and the locking mechanisms, above and below the sets of teeth, as soon as approximate compensation for the respective load has been obtained. As a result, locking mechanisms (16) can be released without the slightest friction between the aforementioned teeth.

It is to be understood that the present invention is not limited to the embodiment described herein and that its scope shall encompass any variations or modifications which may be introduced by persons skilled in the art consistent with the appended claims.

We claim:

1. A method of facilitating disengagement of a vertically displaceable rack and a locking member of an offshore platform lifting mechanism, the locking member having teeth in locked engagement with complementary teeth of the rack with a high vertical stress between the engaged teeth of the locking member and the rack, the locking member being displaceable transversely away from the rack to disengage therefrom and transversely toward the rack to lockingly engage therewith, said method comprising the steps of:

measuring vertical stress between the rack and the locking member, converting the measured vertical stress into an electrical control signal, and applying a force to the rack in response to the control signal, said force substantially offsetting the measured vertical stress so that the rack and the locking member may be disengaged with substantially no vertical stress therebetween.

2. The method of claim 1, wherein said force is applied by a motor-driven pinion gear engaged with the teeth of the rack and wherein the drive motor for the pinion gear rotates the pinion gear in accordance with said control signal to apply said force.

3. The method of claim 1, further comprising measuring non-vertical stress between the rack and the locking member and apply different levels of force to opposite sides of the rack to offset said non-vertical stress.

4. The method of claim 1, further comprising adjusting the rack relative to the locking member to provide an even distribution of vertical play between the rack and the locking member, above and below the rack teeth, such that the locking member may be disengaged from the rack without friction.

* * * * *